US005481507A

United States Patent [19]

Suzuki et al.

[11] Patent Number: 5,481,507

[45] Date of Patent: Jan. 2, 1996

[54] ELECTRONIC TIMEKEEPING DEVICE REDUCED ADJUSTMENT DATA STORAGE REQUIREMENT

[75] Inventors: Yutaka Suzuki, Nagaokakyo; Takumi Ishida, Amagasaki; Masaharu Hayakawa, Nagaokakyo, all of Japan

[73] Assignee: Mitsubishi Denki Kabushiki Kaisha, Tokyo, Japan

[21] Appl. No.: 339,690

[22] Filed: Nov. 14, 1994

[30] Foreign Application Priority Data

Nov. 29, 1993 [JP] Japan ..... 5-298090

[51] Int. Cl.[6] ..... G04B 18/00

[52] U.S. Cl. ..... 368/200; 368/201

[58] Field of Search ..... 368/155–157, 368/200–202; 331/116, 176

[56] References Cited

U.S. PATENT DOCUMENTS

| | | | |
|---|---|---|---|
| 4,407,589 | 10/1983 | Davidson et al. | 368/201 |
| 4,456,386 | 6/1984 | Dellea . | |
| 4,707,145 | 11/1987 | Ishida | 368/201 |
| 4,708,491 | 11/1987 | Luitje | 368/156 |
| 4,903,251 | 2/1990 | Chapman | 368/156 |
| 5,327,404 | 7/1994 | Nolan | 368/201 |

FOREIGN PATENT DOCUMENTS

| | | |
|---|---|---|
| 54-14277 | 2/1979 | Japan . |
| 63-70616 | 3/1988 | Japan . |
| 2-69790 | 5/1990 | Japan . |
| 4-50793 | 2/1992 | Japan . |

*Primary Examiner*—Vit W. Miska

[57] ABSTRACT

To produce a time-base signal for timekeeping, an oscillator circuit generates an oscillator clock signal, which is counted cyclically with a programmable cycle length to establish a time-base cycle. The time-base signal is set and reset once in each time-base cycle. The oscillator clock signal is also counted with a fixed cycle length to establish an adjustment cycle, which is longer than the time-base cycle. In each adjustment cycle, the length of one or more time-base cycles is altered by a total amount determined by adjustment data stored in a non-volatile memory, then the time-base cycle length is restored to its nominal value. The average frequency of the time-base signal can be adjusted by writing appropriate adjustment data in the non-volatile memory.

17 Claims, 12 Drawing Sheets

FREQUENCY COUNTER
ADJUSTMENT DATA CALCULATOR
ADJUSTABLE FREQUENCY DIVIDER
NON-VOLATILE MEMORY
FREQUENCY DIVIDER
TUE
10 : 10 : 43
1-Hz
RESET
SEC
MIN
HR
DAY
X
B
ΔM
1
2
3
4
5
6
7
8
9
10
11
12
13
14
15
16
17
18
19
20
20a
20b
21
22
23
24

WED
10 : 23 . 12
10
GRID LINES
5
SEGMENT LINES
8
TIMER MICROCONTROLLER
42
Vcc
RESET
GND
KEY-SCAN OUTPUT
KEY INPUT
41
RESET
1
2
REW
STOP
PLAY
REC
FF
ADJ
DAY
HR
MIN
SEC
24
43
18
17
16
15
DO
DI
SK
CS
EEPROM
7
NCSK
SO
SI
SYSTEM MICROCONTROLLER
39
REMOTE CONTROL RECEIVER
40

ELECTRONIC TIMEKEEPING DEVICE REDUCED ADJUSTMENT DATA STORAGE REQUIREMENT

BACKGROUND OF THE INVENTION

This invention relates to an electronic timekeeping device, such as a timer, real-time clock, or the like that employs a crystal oscillator to generate a time-base signal, more specifically to an improved method of compensating for oscillator frequency error.

Electronic timekeeping devices are often built into audio and video equipment such as video cassette recorders, where they have the important function of enabling broadcasts to be recorded automatically at preset times. Needless to say, this function requires accurate timekeeping.

The crystal oscillator in an electronic timekeeping device is part of an oscillator circuit comprising resistors, capacitors, and other electronic circuit elements. The circuit oscillates at a frequency determined by the dimensions and characteristics of the crystal and of these other circuit elements. Although a crystal oscillates with a comparatively stable and accurate natural frequency, slight deviations of its natural frequency from the nominal value, as well as variations in resistance, capacitance, and other electrical characteristics in the oscillator circuit, can cause the output frequency of the oscillator circuit to deviate significantly from its intended value. Timekeeping errors exceeding a minute per month cannot be ruled out. Errors of this magnitude are unacceptable, so they must be corrected by adjusting the timekeeping device when it is manufactured.

One common method of adjustment employs a variable trimmer capacitor in the oscillator circuit, but this method is widely regarded as unsatisfactory. A trimmer capacitor is an expensive component, and it must be adjusted manually, a process which introduces human error and labor costs, takes time, and is inherently imprecise. Moreover, manual adjustment is apt to be a recurring nuisance, because if any component of the oscillator circuit is replaced, the adjustment must be performed again.

A known method of avoiding the problems of manual adjustment is to equip the timekeeping device with a programmable frequency divider controlled by a value stored in a non-volatile memory. The output frequency can then be adjusted by writing appropriate data in the non-volatile memory. According to one conventional version of this method, the non-volatile memory stores the full value of the frequency division ratio. According to another version, the non-volatile memory stores the deviation of this value from a nominal value.

Consider, however, the common case of a crystal with a natural frequency of approximately 4.194304 MHz, which is divided by approximately two to the twenty-second power ($2^{22}$) to obtain a 1-Hz output signal. If the non-volatile memory stores the entire frequency division ratio, it must store a twenty-three bit value. Even if it stores only the deviation from the nominal value, to catch all possible deviations with a high degree of certainty, the non-volatile memory must still store a fairly large number of bits. The manufacturer may be quite confident that the frequency error will not exceed two hundred parts per million (±200 ppm), for example, but for a 4.194304-MHz crystal this corresponds to ±839 Hz, so eleven bits must be stored (including one sign bit). It would be desirable to reduce the stored information to eight bits, so as to use up only one byte of non-volatile memory, but the maximum signed value that can be expressed in one byte is only ±127.

SUMMARY OF THE INVENTION

It is accordingly an object of the present invention to adjustably generate a time-base signal by a method that reduces the number of bits of adjustment data that need to be stored.

Another object of the invention is to provide an electronic timekeeping device implementing the invented method.

Still another object of the invention is to program a timer microcontroller to implement the invented method.

In the invented method of generating a time-base signal, adjustment data are stored in a non-volatile memory. An oscillator circuit generates an oscillator clock signal, which is counted cyclically with a programmable cycle length to establish a time-base cycle. The time-base cycles have a certain nominal length. The time-base signal is set and reset once per time-base cycle. The oscillator clock signal is also counted with a fixed cycle length to establish an adjustment cycle, which is longer than the time-base cycle.

In each adjustment cycle, the length of at least one time-base cycle is altered from its nominal value. The total alteration in one adjustment cycle is determined by the adjustment data. After the total alteration has been completed, the time-base cycle length is restored to its nominal value.

The frequency of the time-base signal can be adjusted by measuring the frequency error of the oscillator clock signal, multiplying the frequency error by a constant, and writing the result into the non-volatile memory.

DETAILED DESCRIPTION OF THE PREFERRED EMBODIMENTS

Embodiments of the invention will be described with reference to the attached drawings. These drawings illustrate the invention but do not define its scope, which should be determined from the appended claims.

Figure 1:
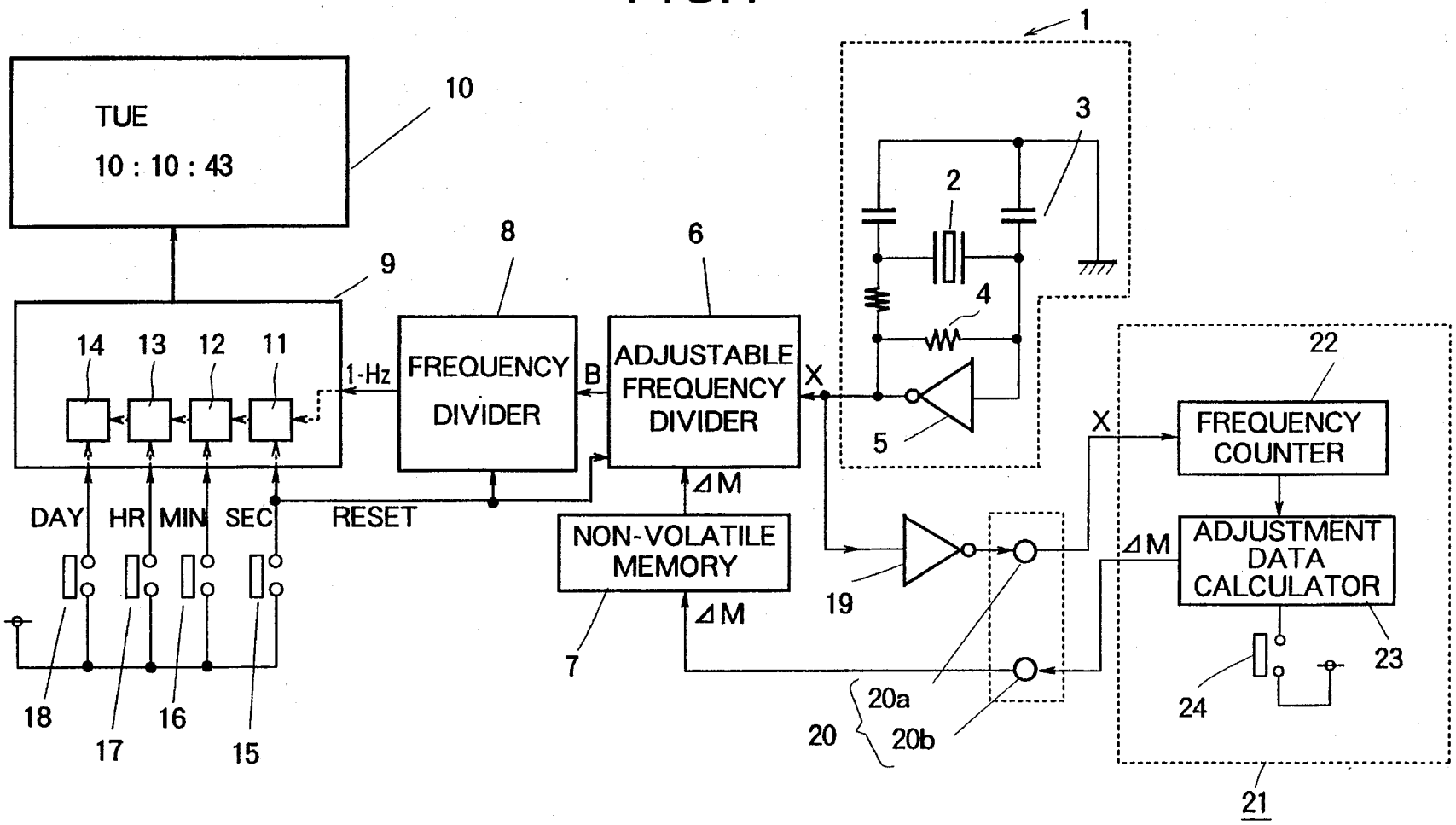
FIG. 1 is a block diagram illustrating a first embodiment of the invention.

FIG. 1 is a block diagram showing the general structure of a first embodiment of the invention. This embodiment has a conventional oscillator circuit 1 comprising a crystal oscillator 2, a pair of load capacitors 3, a pair of resistors 4, and a complementary metal-oxide-semiconductor (CMOS) inverter 5. The capacitors 3 are not of the trimmable type, but have fixed capacitance values. The structure and operation of this oscillator circuit 1 are well known, so a detailed description will be omitted. The oscillator circuit 1 outputs an oscillator clock signal X having an oscillator frequency fs with a certain nominal value ft.

In this embodiment the nominal frequency ft will be 4.194304 MHz, although of course the invention is not limited to any specific value of ft. It will be assumed that fs does not differ from ft by more than ±200 ppm, or ±839 Hz. This assumption is reasonable, as the frequency error normally does not exceed one-tenth that amount.

The oscillator clock signal X is input to a novel adjustable frequency divider 6, the internal structure of which will be described later. The adjustable frequency divider 6 divides the oscillator frequency fs in a manner to be explained below, using adjustment data ΔM stored in a non-volatile memory 7, to create a time-base signal B which it supplies to a frequency divider 8. The frequency divider 8 further divides the frequency of this time-base signal B to obtain a 1-Hz signal, which it sends to a time-and-day counting circuit 9. The time-and-day counting circuit 9 creates signals indicating the second, minute, hour, and day of the week. These signals control a display device 10 on which the time and day are displayed.

Internally, the time-and-day counting circuit 9 comprises four cascaded counters 11, 12, 13, and 14, which count seconds, minutes, hours, and days, respectively. The seconds counter 11, for example, counts the 1-Hz signal output by the frequency divider 8, the count cycling from zero to fifty-nine, then returning to zero and starting over. Each time the count returns to zero, the seconds counter 11 outputs a pulse to the minutes counter 12. The minutes counter 12 counts these pulses in similar fashion and outputs one pulse per hour to the hours counter 13. The hours counter 13 and day counter 14 operate in an analogous manner. The count values in the counters 11, 12, 13, and 14 provide the basis of the data furnished to the display device 10.

The counters 11, 12, 13, and 14 are coupled to respective keys 15, 16, 17, and 18, by which their counts can be adjusted. For example, when the day key 18 is depressed, the day counter 14 is incremented by one. When the seconds key 15 is depressed, the seconds counter 11 is incremented by one and a reset signal is sent to the frequency dividers 6 and 8, so that the time can be adjusted with an accuracy of better than one second.

The oscillator clock signal X output by the oscillator circuit 1 is also fed to an inverter 19, to generate a test signal at an output terminal **20*a*. An input terminal 20*b* is coupled to the non-volatile memory 7, enabling data to be written into the non-volatile memory 7. Terminals 20*a* and 20*b* will be referred to as the adjustment terminals 20. Adjustment equipment 21 can be coupled to the adjustment terminals 20** to measure the frequency error of the oscillator frequency fs and determine the adjustment data ΔM.

The signal input to the frequency counter 22 from terminal **20*a* will again be denoted by the oscillator-clock symbol X. The signal at terminal 20*a*** is actually the inverse of X, but the difference is immaterial, because X and its inverse have the same frequency fs.

The adjustment equipment 21 comprises a frequency counter 22, adjustment data calculator 23, and adjustment switch 24. The frequency counter 22 measures the frequency fs of the signal X received from terminal **20*a*. From the output of the frequency counter 22, the adjustment data calculator 23 calculates the frequency error and the adjustment data ΔM, which it sends to terminal 23*b* when the adjustment switch 24** is depressed.

Figure 2:
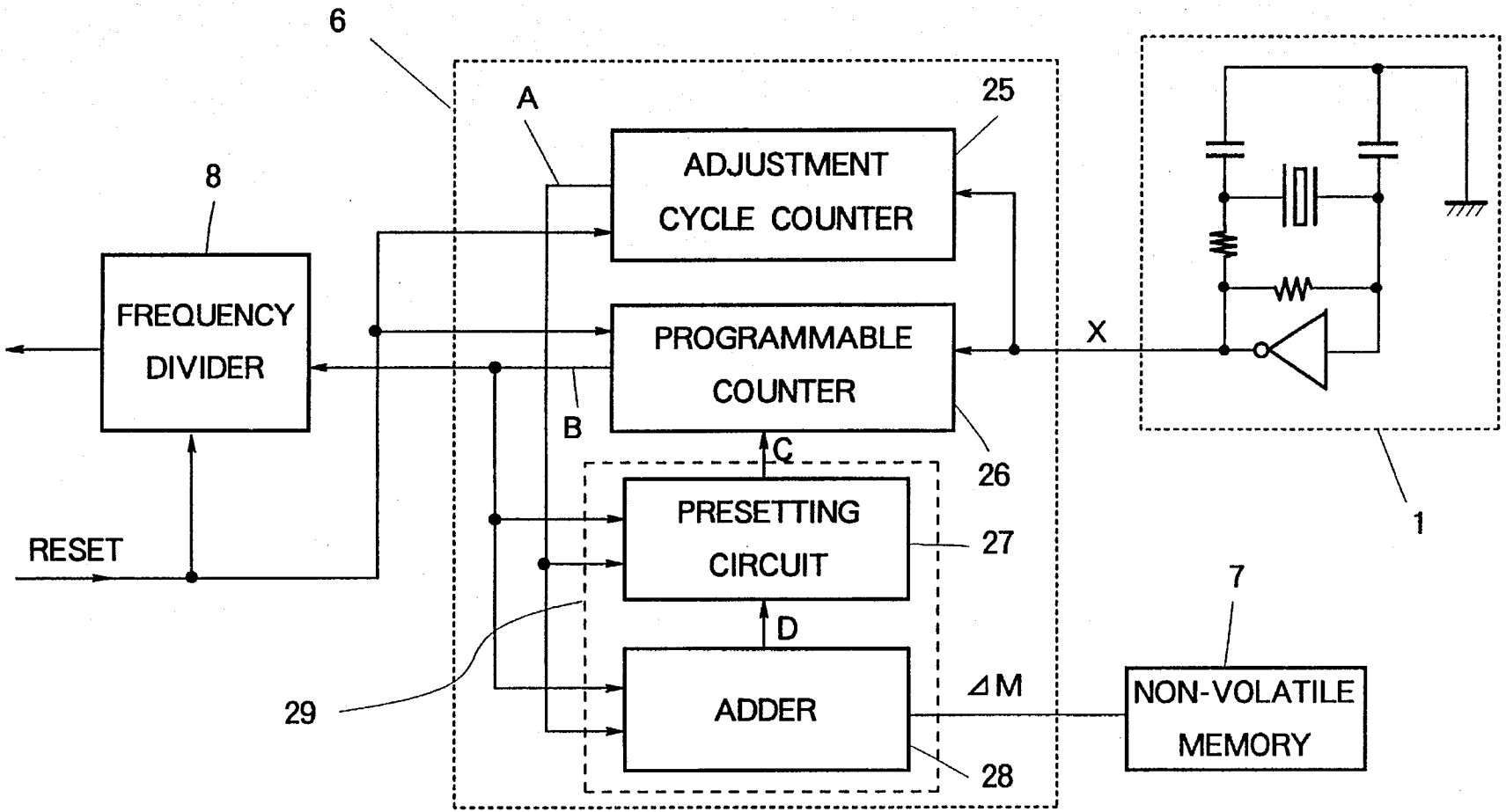
FIG. 2 illustrates the detailed structure of the adjustable frequency divider in FIG. 1.

FIG. 2 shows the internal structure of the adjustable frequency divider 6, which comprises an adjustment cycle counter 25, a programmable counter 26, a presetting circuit 27, and an adder 28. The presetting circuit 27 and adder 28 are elements of a control circuit 29.

The adjustment cycle counter 25 is a divide-by-N counter that counts the oscillator clock signal X output from the oscillator circuit 1 cyclically, to establish an adjustment cycle. At every N-th oscillator clock pulse, the adjustment cycle counter 25 overflows, resets itself to an initial value such as zero, and generates an adjustment timing pulse A.

The programmable counter 26 also counts the oscillator clock signal X cyclically, the cycle length in this case being a preset value C. At the C-th count the programmable counter 26 overflows, resets itself to an initial value, and begins counting again. At each overflow the programmable counter 26 also sets the time-base signal B to, for example, a certain positive voltage level, then resets signal B to, for example, the ground level, thereby generating an output pulse. The time-base signal B thus consists of overflow pulses from the programmable counter 26.

The preset value C is loaded anew from the presetting circuit 27 into the programmable counter 26 each time the programmable counter 26 overflows. The presetting circuit 27 is adapted so that it normally loads a nominal preset value M, which is less than N.

When the adjustment cycle counter 25 generates an adjustment timing pulse A, however, at the next overflow pulse B from the programmable counter 26, the presetting circuit 27 loads a value M+ΔM supplied by the adder 28. In its next cycle the programmable counter 26 will overflow at the (M +ΔM)-th count instead of the M-th count. After this next overflow, the presetting circuit 27 will again load the nominal preset value M. The value of ΔM may be positive, negative, or zero.

The adder 28 stores the value of M internally, and obtains ΔM from the non-volatile memory 7. Upon receiving an adjustment timing pulse A from the frequency counter 22, the adder 28 adds these two values together and outputs their sum M +ΔM as preset data D to the presetting circuit 27.

The invention is not restricted to any particular values of M and N, but it is necessary for N to be greater than M, and convenient if M and N are both powers of two. In this embodiment M will be 2048 ($2^{11}$), and N will be 524,288 ($2^{19}$). Accordingly, the time-base cycle has a nominal length, expressed in seconds, of 2048/fs, while the length of the adjustment cycle is 524,288/fs.

In general there are N/M nominal time-base cycles per adjustment cycle. In this embodiment N/M equals 256 ($2^8$), so there are substantially 256 time-base cycles per adjustment cycle. The programmable counter 26 will be preset to the nominal value M in 255 out of these 256 cycles, and to the adjusted value M+ΔM once every 256 cycles.

When the seconds key 15 in FIG. 1 is depressed, the resulting reset signal resets the adjustment cycle counter 25 and programmable counter 26 to their initial values.

The counter circuits shown in FIG. 2 are well known to those skilled in the art, so further structural details will be omitted. The non-volatile memory 7 may be, for example, an electrically erasable programmable read-only memory (EEPROM), or a battery-backed-up static random access memory (SRAM).

Next the operation of determining the value ΔM to be stored in the non-volatile memory 7 will be described.

Referring again to FIG. 1, when the adjustment equipment 21 is coupled to the adjustment terminals 20, the frequency counter 22 counts the frequency fs of the oscillator clock signal X. The inverter 19 serves to isolate the oscillator circuit 1 from the frequency counter 22, so that the oscillator frequency is not affected by the presence of the frequency counter 22. By counting for an accurately known period of time, the frequency counter 22 obtains the oscillator frequency fs to, for example, the nearest integer hertz value, and outputs this value to the adjustment data calculator 23. The adjustment data calculator 23 subtracts the nominal frequency ft to determine the frequency error Δf, then multiplies this frequency error Δf by a constant value to calculate the value of ΔM. When the adjustment switch 24 is depressed, this ΔM value is sent via terminal **20*b* and written in the non-volatile memory 7**.

In the present embodiment ft is 4.194304 MHz and N is 524,288, so there are eight adjustment cycles per second, and the frequency error Δf must be multiplied by ⅛ to obtain the adjustment data ΔM. This will be demonstrated mathematically below, using the symbol Tp to represent the average cycle length of the programmable counter 26, i.e. the average cycle length of a time-base signal B.

As explained in FIG. 2, the value preset in the programmable counter 26 is normally M, but is adjusted by ΔM once every N/M cycles. The length of a normal time-base cycle is M/fs, and the length of an adjusted time-base cycle is (M+ΔM)/fs. The average time-base cycle length Tp is therefore:

$$Tp=\{[(N/M)-1]\times M/fs+(M+\Delta M)/fs\}\times M/N$$

Multiplying both sides of this equation by fs, $$\begin{aligned} Tp\times fs &= \{[(N/M)-1]\times M+(M+\Delta M)\}\times M/N \\ &= (N+\Delta M)\times M/N \end{aligned}$$

Since fs=ft+Δf, $$Tp\times(ft+\Delta f)=M+(\Delta M\times M/N)$$

For the adjustment to be correct, Tp must be equal to M/ft, so $$M/ft\times(ft+\Delta f)=M+(\Delta M\times M/N)$$

After rearranging terms, $$\begin{aligned} \Delta f/ft &= \Delta M/N \\ \Delta M &= \Delta f\times(N/ft) \end{aligned}$$

In the present embodiment, as noted above, N is 524,288, or $2^{19}$ and ft is 4,194,304 Hz or $2^{22}$. Accordingly, $$\begin{aligned} \Delta M &= \Delta f\times 524{,}288/4{,}194{,}304 \\ &= \Delta f\times 1/8 \end{aligned}$$

Given that the frequency error Δf does not exceed ±200 ppm, or ±839 Hz, the value of ΔM in the present embodiment will not exceed ±105. The non-volatile memory 7 accordingly needs a capacity of only eight bits (one byte) to store the adjustment data ΔM, including the sign bit.

If the invented timekeeping device is used in an audio or video device such as a video cassette recorder, ΔM can be stored in a spare byte in a non-volatile memory used for some other purpose: for example, in a memory used to store preset frequencies for TV or FM tuning. This enables the invention to be configured at a low cost. The advantage of keeping ΔM within one byte is that a spare byte is more likely to be available than is a spare two-byte area or larger memory area.

After the value of ΔM has been written in the non-volatile memory 7 and the adjustment equipment 21 is disconnected from the adjustment terminals 20, the adjustable frequency divider 6 will operate as described above, generating a time-base signal B with an average period Tp of M/ft, that is, with a frequency of ft/M. The frequency divider 8 divides this frequency by a further factor of ft/M to obtain a 1-Hz signal. In the present embodiment, ft/M is 2048 Hz ($2^{22}$ Hz/$2^{11}$), so the frequency divider 8 should divide the frequency of the time-base signal B by 2048.

The operations of subtracting ft from fs and dividing by eight can be performed nearly instantly by a simple arithmetic circuit built into the adjustment data calculator 23. Accordingly, the operator has only to connect the adjustment equipment 21 to the adjustment terminals 20, wait briefly for the frequency measurement to be completed, then press the adjustment switch 24. As soon as the value ΔM has been written into the non-volatile memory 7, the adjustment equipment 21 can be disconnected. The entire adjustment can be finished in a very short time, with little opportunity for human error because the computations are done automatically.

The arithmetic operations and presetting operations performed by the control circuit 29 in FIG. 2 need only be carried out at a rate of fs/N: in the present embodiment, at a rate of 8 Hz (eight times per second). This comparatively slow rate means that a microcontroller can be programmed to execute the functions of the control circuit 29 in FIG. 2 without placing a significant load on its central processing unit.

When the adjustment data calculator 23 multiplies Δf by ⅛ to calculate ΔM, it loses the three least significant bits of Δf. The average frequency of the time-base signal B may accordingly be in error by as much as 8 Hz, or roughly ±1 ppm. This amounts to an error of only about three seconds per month, however, which is less than error to be expected from ambient temperature fluctuations, and is well within the satisfactory range for practical use.

Figure 3:
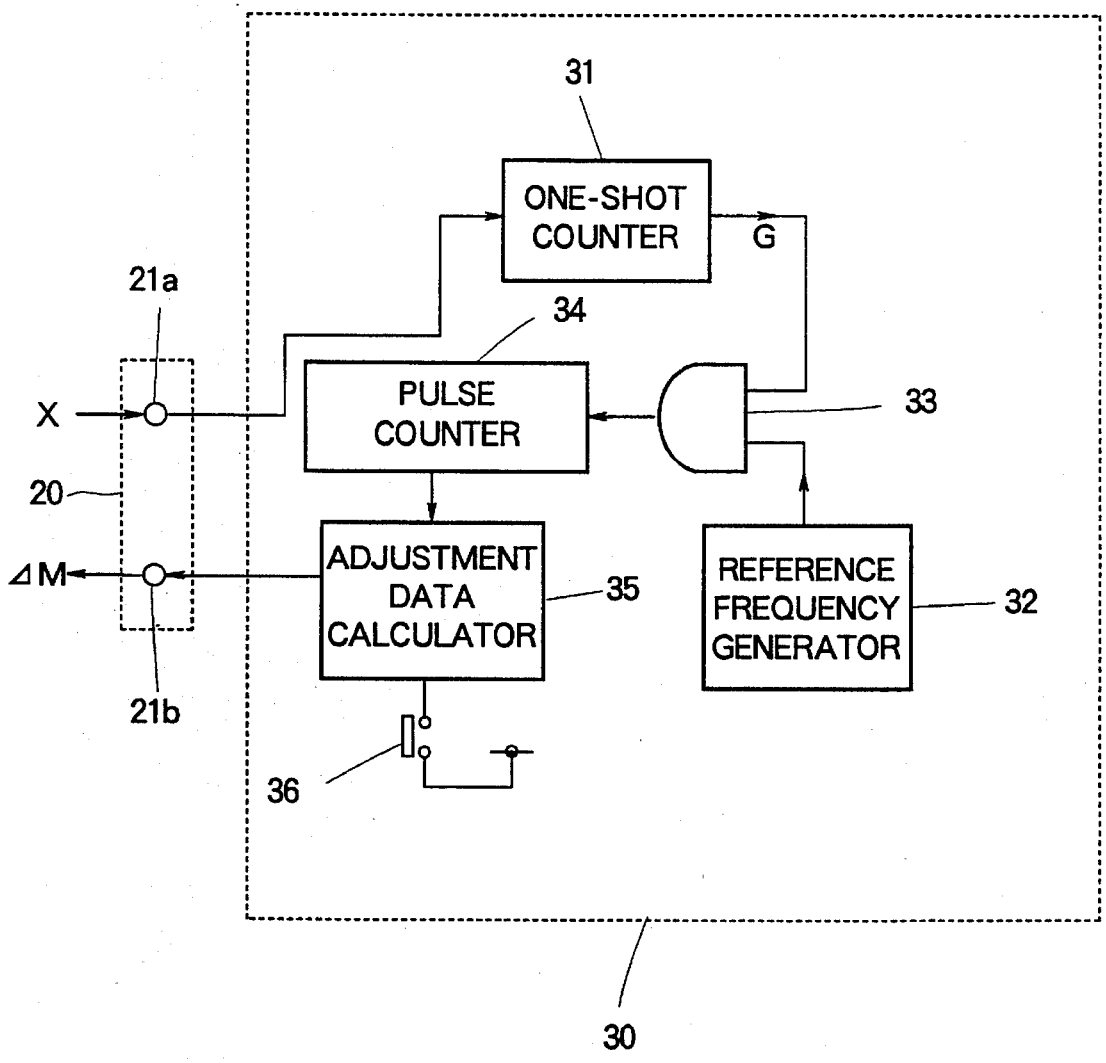
FIG. 3 illustrates a variation of the adjustment equipment in FIG. 1.

FIG. 3 shows another type of adjustment equipment that can be used with the invented timekeeping device, instead of the adjustment equipment 21 in FIG. 1. The adjustment equipment 30 in FIG. 3 comprises a one-shot counter 31, reference frequency generator 32, AND gate 33, pulse counter 34, adjustment data calculator 35, and adjustment switch 36. Instead of counting the oscillator clock signal X from terminal **21*a* for an accurately determined period of time, this adjustment equipment 30 counts pulses output by the reference frequency generator 32** for a period of time measured by using the oscillator clock signal X.

The one-shot counter 31 in FIG. 3 counts the oscillator clock signal X obtained from terminal 21*a*, and outputs a gate signal G. More specifically, the one-shot counter 31 sets the gate signal G to the high level, counts 524,288 oscillator clock cycles, then resets the gate signal G to the low level, thereby generating a gate signal with a high pulse width Tg of 524,288/fs. The reference frequency generator 32 outputs a pulse signal signal with an accurately calibrated frequency of 4.194304 MHz. While the gate signal G from the one-shot counter 31 is high, the AND gate 33 feeds the pulses from the reference frequency generator 32 to the pulse counter 34, which counts them. Letting ft denote the frequency output by the reference frequency generator 32 and Δf the difference between fs and ft as before, since fs=ft+Δf, $$Tg=524{,}288/(ft+\Delta f)$$

During this period Tg, the pulse counter 34 will count Pn pulses, where $$\begin{aligned} Pn &= ft\times Tg \\ &= ft\times 524{,}288/(ft+\Delta f) \end{aligned}$$

If the frequency fs of the oscillator circuit 1 had the nominal value of ft, then the number of pulses counted by the pulse counter 34 would have the nominal value Pt of 524,288. If fs is not equal to ft, the actual number of pulses counted Pn will differ from Pt by an amount ΔPt, so that Pn=Pt+ΔPt. Thus, $$Pt+\Delta Pt=ft\times 524{,}288/(ft+\Delta f)$$

Multiplying both sides by (ft+Δf) and substituting Pt=524,288 gives:

$$(524{,}288+\Delta Pt)\times(ft+\Delta f)=ft\times 524{,}288$$

$$(524{,}288\times ft)+(\Delta Pt\times ft)+(524{,}288+\Delta Pt)\times\Delta f=ft\times 524{,}288$$

$$(\Delta Pt\times ft)+(524{,}288+\Delta Pt)\times\Delta f=0$$

$$\Delta f=-(\Delta Pt\times ft)/(524{,}288+\Delta Pt)$$

As noted previously, it is reasonable to assume that ΔPt does not exceed ±200 ppm with respect to Pt, which is 524,288. Treating (524,288+ΔPt) as equal to 524,288 in the denominator of the above equation will accordingly not cause an error of more ±200 ppm, or one part in five thousand. Since ft=4.194304 MHz, which is 8×524,288 Hz, to within one part in five thousand, $$\Delta f=-8\Delta Pt$$

Since ΔM is Δf/8, it follows that ΔM is substantially equal to −ΔPt. Since −ΔPt=Pt−Pn, to compute ΔM, the adjustment data calculator 35 only has to subtract Pn from Pt, i.e. from 524,288. This operation can be carried out almost instantly by a simple arithmetic circuit in the adjustment data calculator 35. The frequency error is in effect multiplied by ⅛ by counting Pn for ⅛ of a second instead of a full second.

As before, the operator only has to connect the adjustment equipment 30 to the adjustment terminals 20, wait briefly for the pulse count to be completed, then press the adjustment switch 36 to have the adjustment data calculator 35 write ΔM into the non-volatile memory 7. If the adjustment equipment 30 is incorporated into automatic test equipment, the entire adjustment operation can be carried out automatically, in a fraction of a second.

Figure 4:
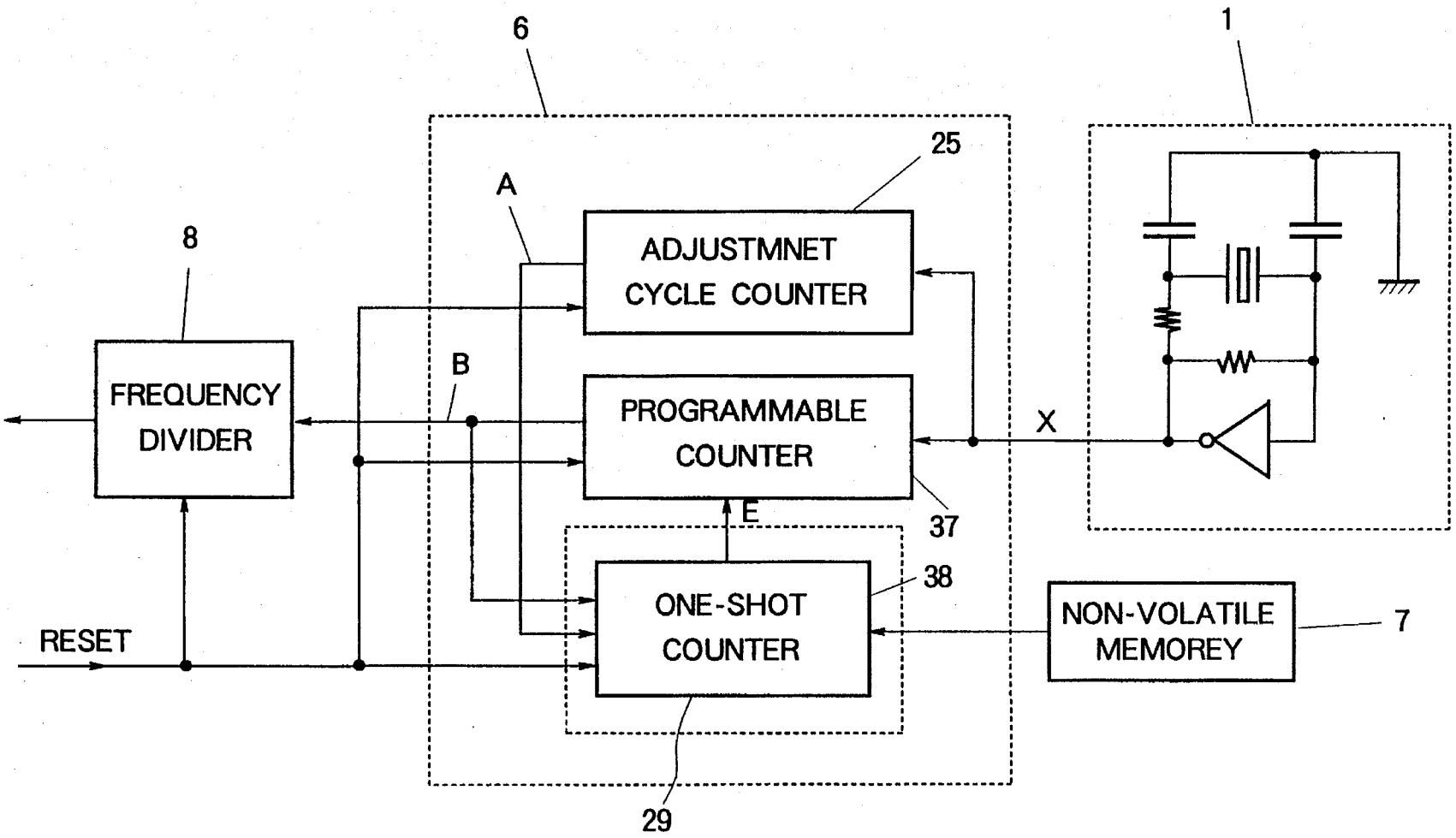
FIG. 4 illustrates a variation of the adjustable frequency divider in FIG. 1.

FIG. 4 shows a possible variation in the internal structure of the adjustable frequency divider 6. The adjustable frequency divider 6 in FIG. 4 comprises an adjustment cycle counter 25 as in FIG. 2, a programmable counter 37, and a control circuit 29 incorporating a one-shot counter 38.

The programmable counter 37 in FIG. 4 counts the oscillator clock signal X with a cycle length of M (2048), M+1 (2049), or M−1 (2047), as selected by a control signal E. The control signal E is generated by the control circuit 29 according to the adjustment timing pulse A received from the adjustment cycle counter 25 and the value of ΔM received from the non-volatile memory 7, using the one-shot counter 38. All three counters in the adjustable frequency divider 6 are reset by the reset signal from the seconds key 15 in FIG. 1, and the one-shot counter 38 is also reset by the adjustment timing pulse A.

When reset, the control circuit 29 sends the programmable counter 37 a control signal E causing the programmable counter 37 to divide the frequency of the oscillator signal by M+1 (2049) if ΔM is positive, and by M−1 (2047) if ΔM is negative. The one-shot counter 38 then counts the time-base signal B output by the programmable counter 37. When the count reaches the absolute value of ΔM, the control circuit 29 changes the control signal E to command the programmable counter 37 to divide by M (2048).

The above operations are repeated each time the adjustment cycle counter 25 produces a timing pulse A, that is, once every N (524,288) counts of the oscillator clock signal X. If ΔM is zero, then when the one-shot counter 38 is reset to zero by a timing pulse A, the count in the one-shot counter 38 already matches the absolute value of ΔM, so the control circuit 29 immediately commands the programmable counter 37 to divide by M (2048).

In FIG. 2, the adjustable frequency divider 6 applied a correction of ΔM once per adjustment cycle, whereas in FIG. 4 the adjustable frequency divider 6 applies a correction of +1 or −1 but does so |ΔM| times during each adjustment cycle. It should be clear that the net effect is the same. The adjustable frequency divider 6 in FIG. 4 has the advantage of producing smoother output, because the cycle length of the time-base signal B never varies by more than +1 or −1 oscillator clock from its nominal value of M.

Next a second embodiment of the invention, one using a microcontroller, will be described with reference to FIGS. 5 to 13. The microcontroller is of the type commonly employed in a video cassette recorder for timer control.

Figure 5:
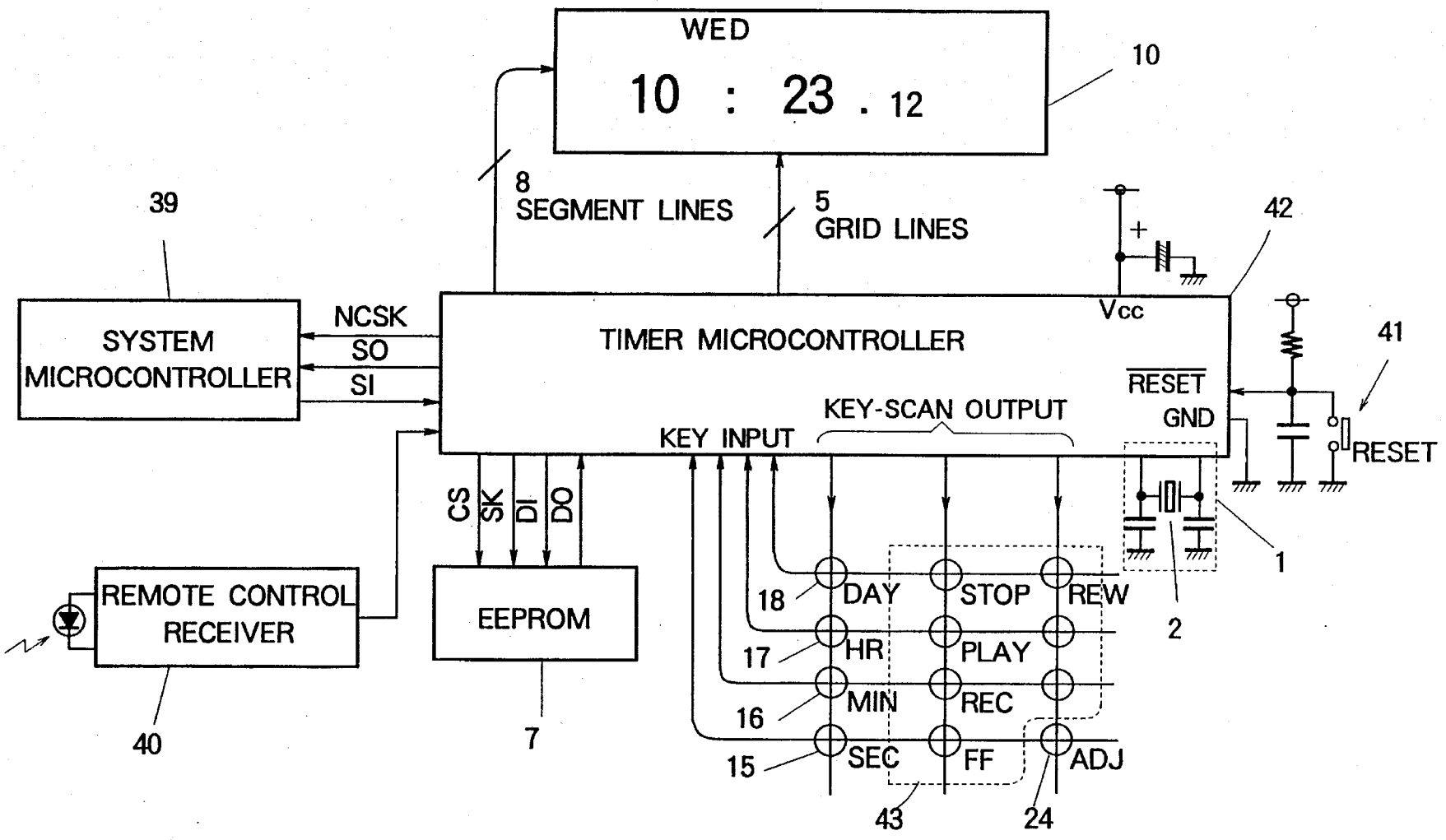
FIG. 5 is a block diagram illustrating a second embodiment of the invention.

FIG. 5 shows the system configuration, using the same reference numerals as in FIG. 1 to denote the oscillator circuit 1 with its crystal oscillator 2, the non-volatile memory 7, the display device 10, the seconds, minutes, hours, and day keys 15, 16, 17, and 18, and the adjustment switch 24. Detailed descriptions of these elements will be omitted, except to remark that the non-volatile memory 7 is an EEPROM of the standard 93C46 type, the display device 10 is a dynamically-driven vacuum fluorescent display, and the crystal 2 in the oscillator circuit 1 now has a nominal frequency ft of 8.388608 MHz.

The new elements in FIG. 5 are a system microcontroller 39, remote control receiver 40, reset switch 41, timer microcontroller 42, and tape control keys 43. The oscillator circuit 1, except for the crystal oscillator 2 and its load capacitors, is integrated into the timer microcontroller 42.

Figure 6:
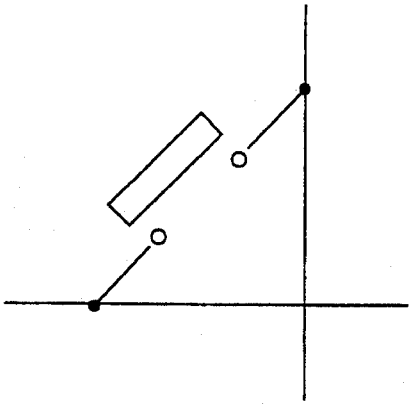
FIG. 6 illustrates the wiring of a key switch in FIG. 5.

The keys and switches 15, 16, 17, 18, 24, and 43 are depicted as circles at the intersections of key input lines and key-scan output lines from the timer microcontroller 42. Referring to FIG. 6, each of these keys is a contact switch coupling one key input line to one key-scan output line. (The key input line and key-scan output line are not directly interconnected at their point of intersection in the drawing.)

Figure 7:
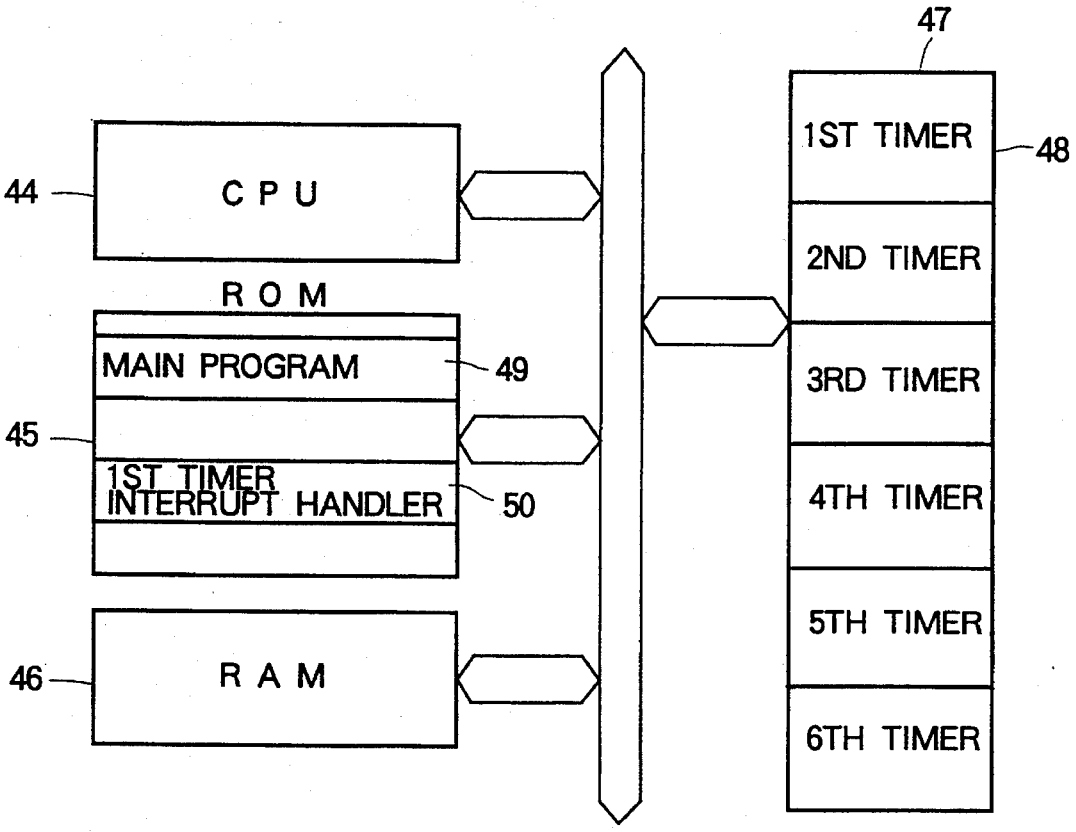
FIG. 7 is a block diagram of the timer microcontroller in FIG. 5.

Referring to FIG. 7, the timer microcontroller 42 is a Mitsubishi M3817M8 comprising a central processing unit (CPU) 44, read-only memory (ROM) 45, random-access memory (RAM) 46, and a set of six timers 47. Of these six timers 47, only the first timer 48 will be used in the present invention, leaving the other timers available for other purposes.

The R0M 45 stores various programs that are executed by the CPU 44. The programs that are relevant to the present invention are a main program 49 and a first timer interrupt handier 50.

The invention is of course not restricted to the M3817M8 microcontroller and 93C46 EEPROM. Other devices with equivalent functions can be used instead.

Figure 8:
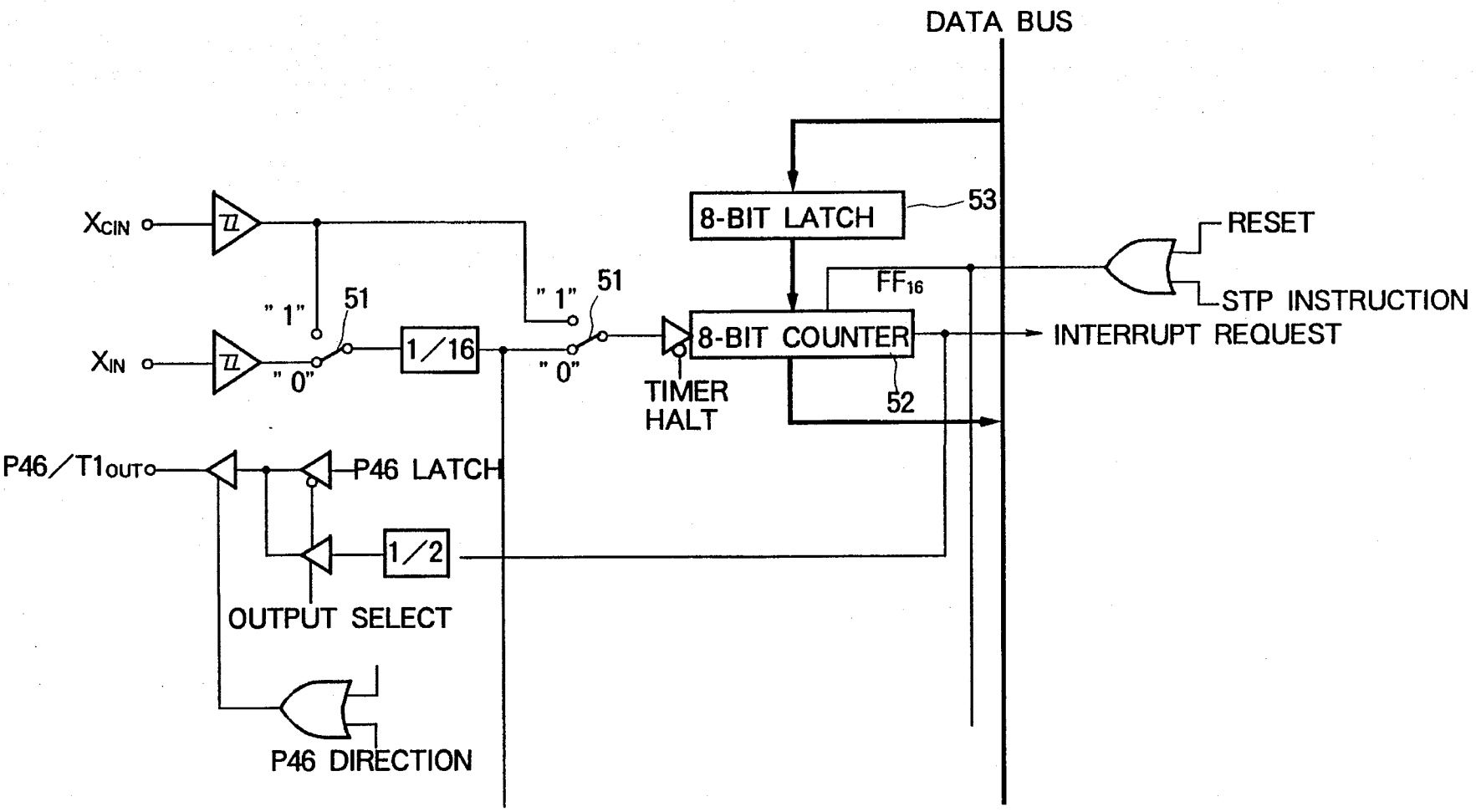
FIG. 8 is a schematic diagram of a timer in FIG. 7.

FIG. 8 shows a schematic diagram of the first timer 48. A thorough description of this diagram will be omitted, since it would obscure the invention with much needless detail, but the following features will be pointed out. $X_{IN}$ is an input terminal that receives the nominally 8.388608-MHz oscillator clock. When the two clock select switches 51 are set as shown, the frequency at $X_{IN}$ is divided by sixteen, and the resulting signal is input to and counted by an eight-bit counter 52. The eight-bit counter 52 overflows at a count determined by the value set in an eight-bit latch 53. If this value is zero, the eight-bit counter 52 overflows once every 256 counts, e.g. at a rate of 8.388608 MHz/(1.6×256) or 2048 Hz. Each overflow generates an interrupt request. If the $T1_{OUT}$ function of the P46/T1$_{OUT}$ pin is selected, each overflow also toggles an output signal at this pin. If the $T1_{OUT}$ function is not selected, P46/T1$_{OUT}$ functions as a general-purpose input/output (I/0) port.

Figure 9:
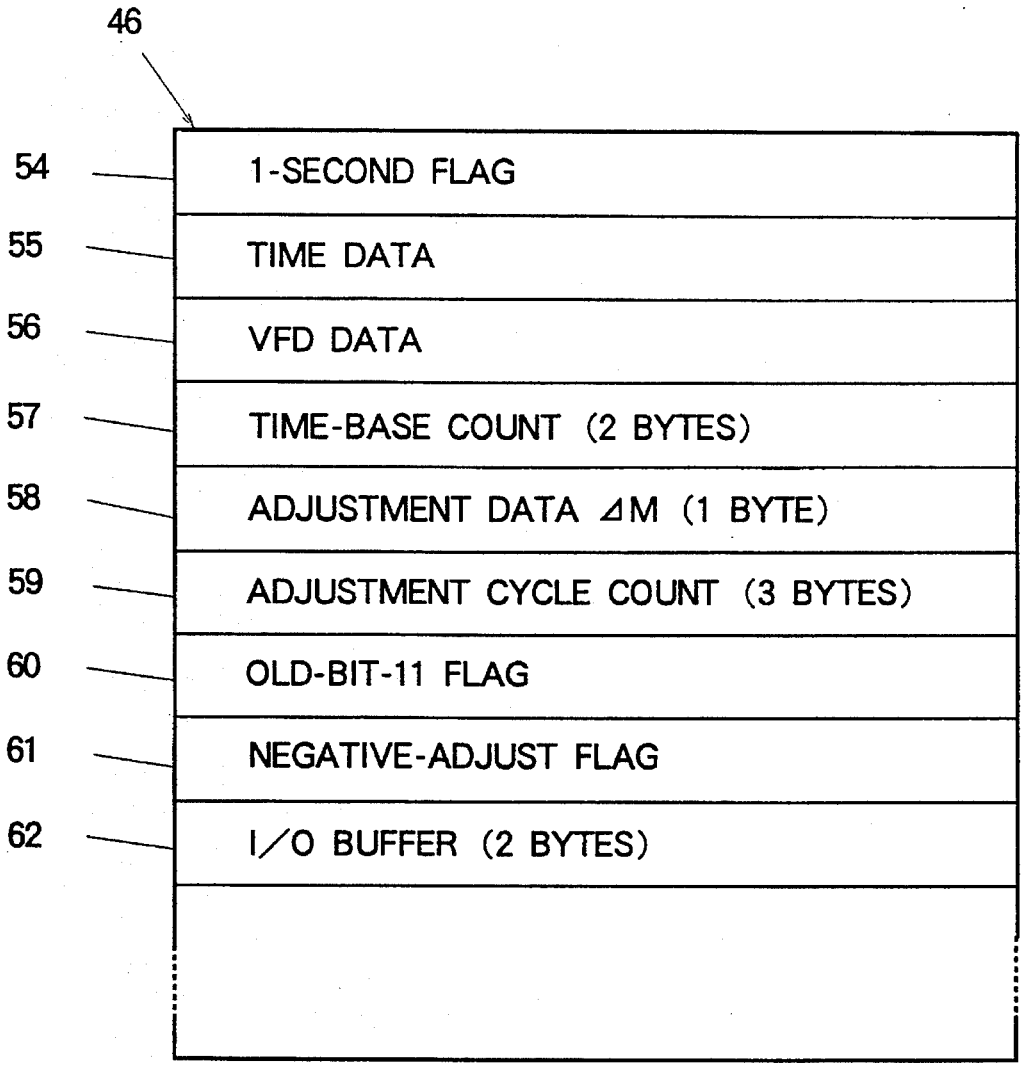
FIG. 9 shows information stored in the timer microcontroller's random-access memory.

Referring to FIG. 9, the RAM 46 in the timer microcontroller 42 has areas for storing a one-second flag 54, time data 55, vacuum fluorescent display (VFD) data 56, a two-byte time-base count 57, one-byte adjustment data ΔM 58, a three-byte adjustment cycle count 59, an old-bit-eleven flag 60, and a negative-adjust flag 61. It also has a two-byte I/0 buffer 62 used for transferring EEPROM data.

For clarity, the three flags 54, 60, and 61 are shown separately, but each flag requires only one bit, so all three flags may be stored in the same byte.

The one-second flag 54 is a signal from the first timer interrupt handler 50 to the main program 49, and is equivalent to the time-base signal B in FIG. 1.

The time data 55 comprise seconds, minutes, hours, and day counts similar to those maintained by the counters 11, 12, 13, and 14 in FIG. 1. The vacuum fluorescent display data 56 comprise these counts converted to the form of data for driving the display device 10.

The time-base count 57 is used to establish the time-base cycle by counting first timer interrupt requests cyclically. The cycle length is programmable, as will be explained below, but has a nominal length of 2048 counts. Since first timer interrupt requests occur at a rate of 2048 Hz, the count has a nominal cycle length of one second. Taken together, the first timer 48 and time-base count area 57 are used to count oscillator clock pulses with a cycle length of 16×256×2048=8,388,608 oscillator cycles.

The adjustment cycle count 59 is used to establish the adjustment cycle by counting first timer interrupt requests cyclically. The adjustment cycle has a flexed length of 524,288 counts, which is equal to 2,147,483,648 oscillator cycles (16×256×524,288=2,147,483,648).

Referring again to FIG. 5, the tape control keys 43 control the usual play, record, stop, fast-forward, and rewind functions of a video cassette recorder. Depressing one of these keys generates an input signal to the timer microcontroller 42, which notifies the system microcontroller 39 of the key-press. The system microcontroller 39 responds by generating signals that control record and playback circuits and the cassette-deck motor. Communication between the system microcontroller 39 and timer microcontroller 42 is carried out over a serial interface comprising a serial clock line NCSK and input and output lines SI and SO.

The timer microcontroller 42 communicates with the EEPROM 7 by four more interface signal lines with the functions of chip select (CS), serial clock (SK), data input (DI), and data output (DO). To read data, for example, the timer microcontroller 42 activates the CS line to select the EEPROM 7, sends a sixteen-bit address, then receives the data stored at that address in the EEPROM 7.

The video cassette recorder also has a remote control unit (not shown) with digit keys for selecting channels and other keys which the user can use instead of the tape control keys 43. Commands from the remote control unit are received by the remote control receiver 40 and relayed to the timer microcontroller 42, then processed by the timer microcontroller 42 and system microcontroller 39.

Figure 10:
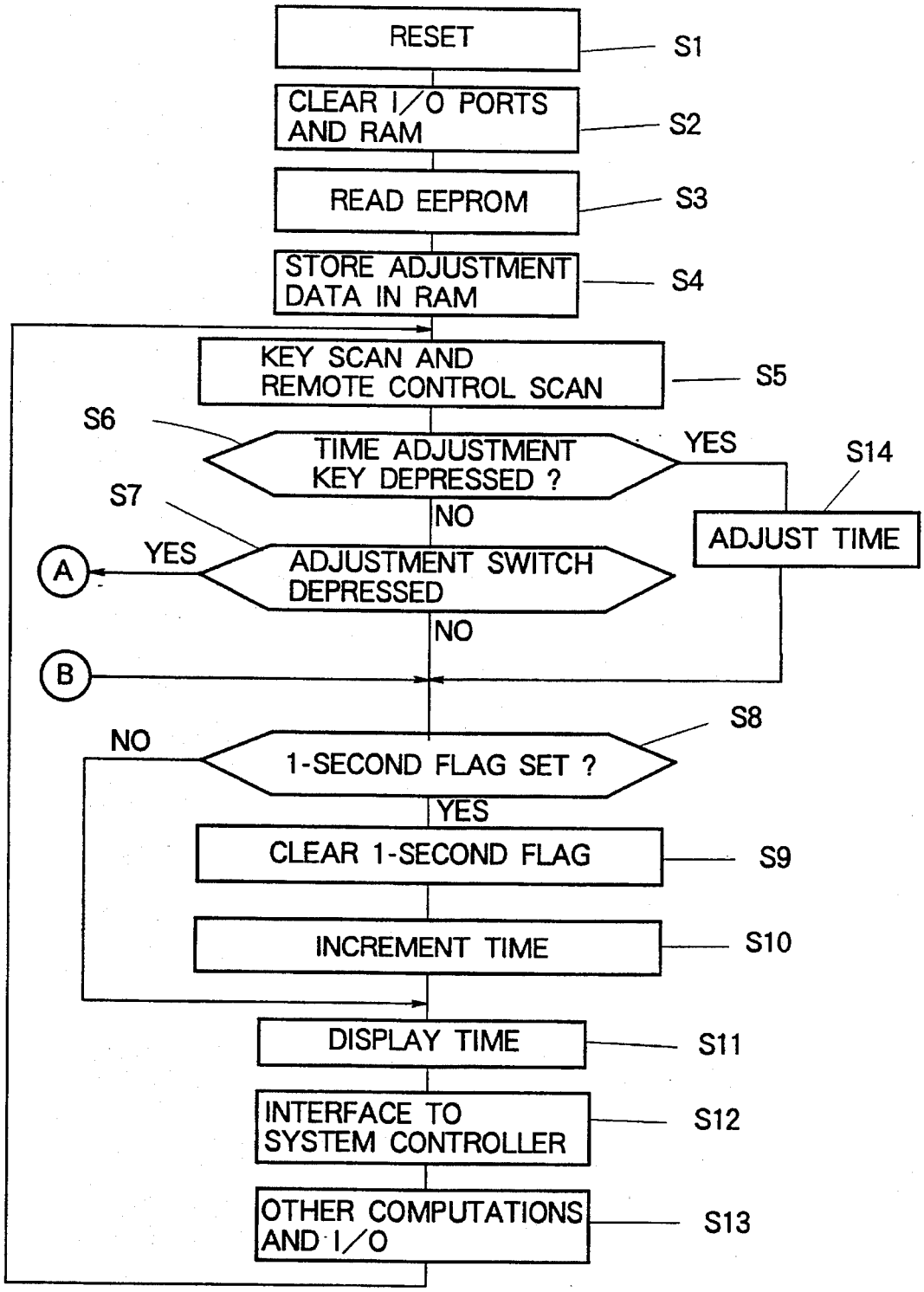
FIG. 10 is a flowchart of the timer microcontroller's main program.

FIG. 10 is a flowchart of the initialization and main processing steps of the main program 49 stored in the R0M 45. The flowchart omits certain parts of the main program 49 that are not relevant to the present invention.

In the first step (S1), the timer microcontroller 42 is reset, e.g. by the reset switch 41. This reset leaves the contents of the RAM 46 and settings of the I/0 ports in undetermined states.

In the next step (S2), the I/0 ports and RAM 46 are initialized by, for example, clearing all their data to zero.

In the next step (S3), the timer microcontroller 42 reads data from the EEPROM 7 into the two-byte I/O buffer 62. The adjustment data ΔM of the present invention comprise one byte (eight bits) of these two bytes.

In the next step (S4), the timer microcontroller 42 transfers this byte of adjustment data ΔM from the I/O buffer 62 to the adjustment data area in the RAM 46. This completes the initialization process as far as the present invention is concerned.

In the next step (S5), the timer microcontroller 42 scans the tape control keys 43 and other keys, and detects remote control input from the remote control receiver 40. If key input is present, the timer microcontroller 42 checks that the input is valid, by verifying that only one key has been pressed and that the same input is obtained on two successive scans.

In the next step (S6), the timer microcontroller 42 decides whether the seconds, minutes, hours, or day key 15, 16, 17, or 18 was pressed. If so, it executes a time setting process described later (step 14). If not, the next step (S7) is executed.

In the next step (S7), the timer microcontroller 42 decides whether the adjustment switch 24 was depressed. If so, it executes a routine which will be described later (steps S51 to S57 in FIG. 13). If not, the next step (S8) is executed.

In the next step (S8), the timer microcontroller 42 checks the one-second flag 54 in its RAM 46. If this flag is set to one, the next step (S9) is executed. If this flag is cleared to 0, the program jumps to step S below.

In the next step (S9), the one-second flag 54 is cleared to zero.

In the next step (S10), the timer microcontroller 42 increments the time by one second by reading the time data 55 from its RAM 46, making necessary modifications, and writing the modified data back into the time data area. This step is carried out once per second, being executed once each time the one-second flag 54 is set to one.

In the next step (S11 the timer microcontroller 42 reads the time data 55 from the RAM 46, converts the data into control data for driving the display device 10, and writes the converted data as VFD data 56 in the RAM 46, so that the day and time will be displayed.

In the next step (S12), the timer microcontroller 42 interfaces with the system microcontroller 39 in order to notify the system microcontroller 39 if the play, record, stop, fast-forward, or rewind key was depressed, and to receive information such as mode information, not directly related to the invention, from the system microcontroller 39.

In the next step (S13), the timer microcontroller 42 performs other computational steps and input/output processing not related to the present invention. At the conclusion of this processing step, the timer microcontroller 42 returns to the key-scan step (S5).

In the time adjustment step (S14), depending on which time adjustment key was pressed, the timer microcontroller 42 reads the seconds, minutes, hours, or day count from the time data 55 in the RAM 46, increments the count, and writes the incremented value back. The incremented value will then be displayed the next time the time display step S11 is executed.

The steps from S5 to S13 constitute a loop in the main program 49 of the timer microcontroller 42. The entire loop is repeated many times each second.

The first timer interrupt handler 50 will be described next with reference to FIGS. 11 and 12. This interrupt handler is executed 2048 times per second, and generates a 1-Hz signal by setting the one-second flag 54 in the RAM 46 at average intervals of one second.

Figure 11:
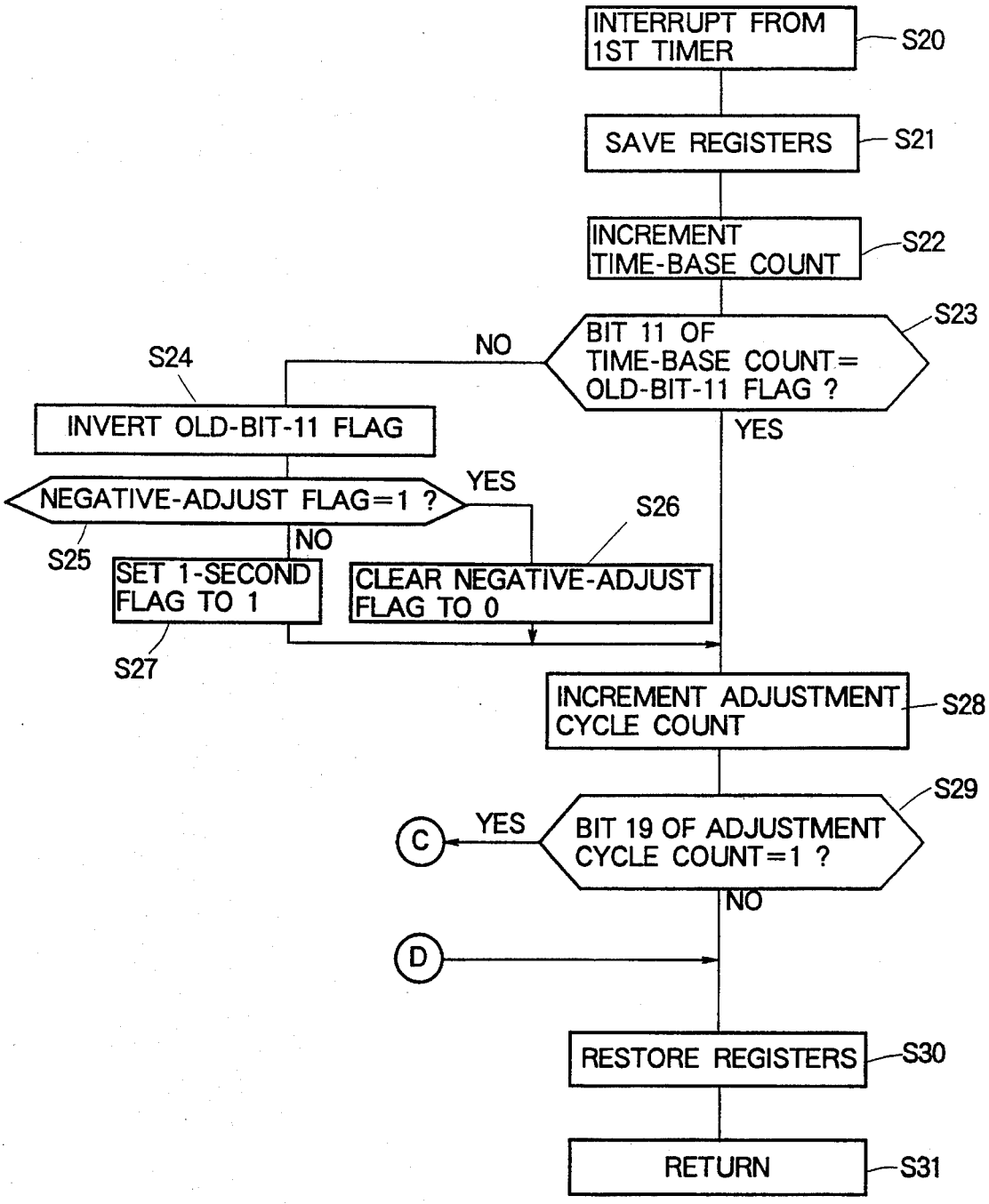
FIG. 11 is a partial flowchart of the timer microcontroller's first timer interrupt handler.

Referring to FIG. 11, in the first step (S20), the first timer 48 overflows and generates an interrupt, causing the timer microcontroller 42 to interrupt its main program 49 and start executing the first timer interrupt handler 50.

In the next step (S21), the contents of all CPU registers that will be used in the first timer interrupt handler 50 are saved onto a stack area (not shown) in the RAM 46.

In the next step (S22), the contents of the time-base count 57 in the RAM 46 is read, incremented, and written back. As a result, bit zero (the least significant bit) of the time-base count 57 toggles at a rate of 1024 Hz, bit ten toggles at a rate of 1 Hz, and bit eleven toggles at a rate of 0.5 Hz. The desired 1-Hz signal can be obtained by detecting transitions (zero-to-one and one-to-zero changes) of bit eleven.

This is done in the next step (S23). The current value of bit eleven in the time-base count 57 is compared with the value of the old-bit-eleven flag 60. If the two are equal, the program proceeds to step S28 below. If they are unequal, indicating a transition, the next step (S24) is executed.

In the next step (S24), the old-bit-eleven flag 60 is inverted, so that it equals the current value of bit eleven in the time-base count 57. This prevents double detection of a transition of bit eleven the next time the interrupt handler is executed.

In the next step (S25), the negative-adjust flag 61 in the RAM 46 is checked. Processing proceeds to step S26 if this flag is set to one, and to step S27 if this flag is cleared to zero.

In step S26, the negative-adjust flag 61 is cleared from one to zero, and processing proceeds to step S28.

In step S27, the one-second flag 54 is set to one, and processing proceeds to step S28. The purpose of steps S25 and S26 is to prevent the one-second flag 54 from being set incorrectly in step S27, by allowing the one-second flag 54 to be set only when the negative-adjust flag 61 is equal to zero. Further explanation will be given later.

In the next step (S28), the adjustment cycle count 59 is incremented by one. The purpose of this adjustment cycle count 59 is to generate an adjustment timing signal at intervals of 524,288 counts, which can be done by detecting transitions of bit nineteen.

In the next step (S29), accordingly, bit nineteen of the adjustment cycle count 59 is tested. If this bit is set to one, the program continues to FIG. 12; otherwise, the next step (S30) is executed.

In the next step (S30), the CPU registers that were saved in step S21 are restored to their previous values.

In the next step (S31), a return instruction is executed to return to the main program 49, which resumes execution from the point at which it was interrupted.

Figure 12:
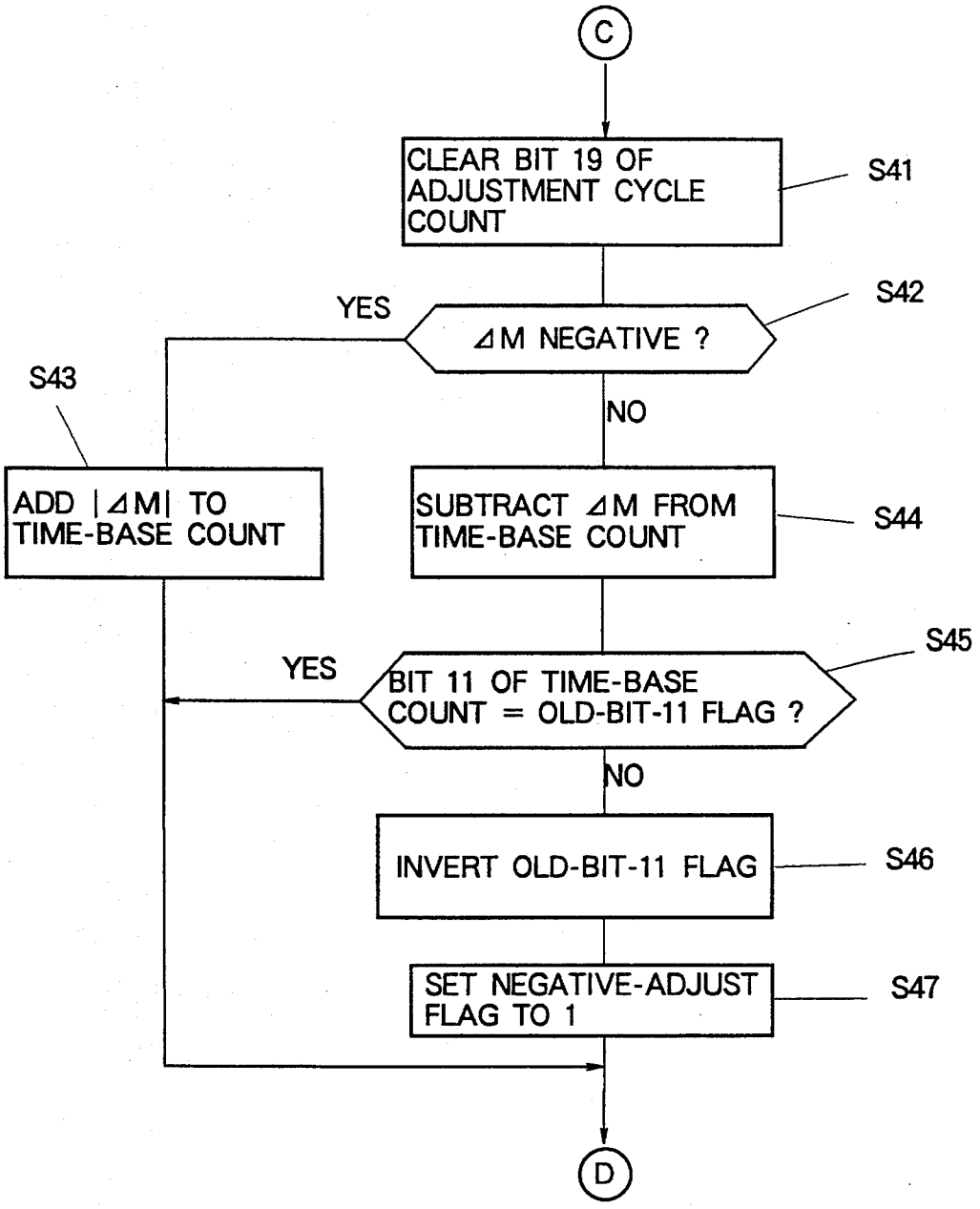
FIG. 12 is a flowchart of the remaining part of the first timer interrupt handler.

If bit nineteen of the adjustment cycle count 59 is set to one in step S29, the additional steps shown in FIG. 12 are executed to adjust the time-base count 57.

In the first step (S41) in FIG. 12, bit nineteen of the adjustment cycle count 59 is cleared to zero. Bit nineteen will therefore by set to one again the next time 524,288 counts are reached.

In the next step (S42), the sign of $\Delta M$ is tested, by testing the sign bit (bit seven) of the adjustment data 58 in the RAM 46. If $\Delta M$ is positive, the process skips to step S44 below. If $\Delta M$ is negative, the next step (S43) is executed.

In the next step (S43), the time-base count 57 is modified by adding the absolute value $|\Delta M|$ of the adjustment data 58. (Equivalently, the negative value of $\Delta M$ is subtracted from the time-base count.) This shortens the time until the next transition of bit eleven of the time-base count 57, as required by the negative value of $\Delta M$. After step S43, the program returns to step S30 in FIG. 11.

In step S44, the positive value of $\Delta M$ is subtracted from the time-base count 57, thereby lengthening the time until the next transition of bit eleven. This is equivalent to temporarily increasing the cycle length of the time-base count 57. However, it is possible that the subtraction operation itself will cause a transition of bit eleven.

In the next step (S45), accordingly, bit eleven of the time-base count 57 is checked, to see whether its value equals the value of the old-bit-eleven flag 60. If it does, the process returns to step S30 in FIG. 11. If it does not, indicating that the subtraction in step S44 produced an extra transition of bit eleven, the next step (S46) is executed.

In the next step (S46), the old-bit-eleven flag 60 is inverted, so that it now matches bit eleven of the time-base count 57.

In the next step (S47), the negative-adjust flag 61 is set to one. This will prevent the next transition of bit eleven of the time-base count 57 from setting the one-second flag 54, by bypassing step S27 in FIG. 11. The overall effect of steps S44 to S47 will be that the current cycle of the time-base count 57 is lengthened by $\Delta M$ as desired.

From the above it can be seen that the first timer interrupt handler 50 normally sets the one-second flag 54 once every 2048 counts, at a nominal rate of 1 Hz. Once every 524,288 counts, however, it adjusts the cycle length to $2048+\Delta M$ counts, so that the average rate at which the one-second flag 54 is set is more exactly equal to 1 Hz. The adjustment is performed at intervals of 524,288/2048 seconds, i.e. intervals of 256 seconds. Since the size of the adjustment is not expected to exceed $\pm 105$, which is about 5% of 2048, it does not exceed one-twentieth of a second. This is not long enough to be noticeable to a human being, and causes no timekeeping problems in a video cassette recorder.

Next the routine executed by the timer microcontroller 42 when the adjustment switch 24 is depressed will be described. In this embodiment, the adjustment switch 24 is depressed at the beginning of the frequency error measurement, rather than the end.

Referring again to FIG. 5, since the oscillator circuit 1 is partly integrated into the microcontroller 42, it would be difficult to measure the oscillator frequency directly. Accordingly, the timer microcontroller 42 uses the first timer 48 to generate a pulse signal for output at port P46, and a frequency counter is used to measure the frequency of this output signal. The frequency of timer interrupts, which is the frequency at which the time-base count 57 in the RAM 46 is incremented, is thereby measured. The nominal value of this frequency is 2048 Hz.

The output signal at port P46 toggles each time the first timer 48 overflows, so it takes two timer overflows to complete one cycle of the output signal, and the output frequency at port P46 is actually equal to one-half the overflow frequency of the first timer 48. To obtain the expected 2048-Hz frequency, the first timer 48 must be set to overflow at intervals of 128 counts instead of 256 counts. This can be done by writing 128 in the eight-bit latch 53 in FIG. 8.

The mathematical explanation given in regard to FIG. 1 still applies if fs and ft are taken to be the actual frequency and nominal frequency at which the first timer 48 overflows, instead of the oscillator clock frequency. That is, N is still 524,288 but ft is now 2048 Hz, and the constant by which the measured frequency error must be multiplied is two hundred fifty-six, as the following calculation shows:

$$\begin{aligned} \Delta M &= \Delta f \times N/ft \\ &= \Delta f \times 524{,}288/2048 \\ &= \Delta f \times 256 \end{aligned}$$

Figure 13:
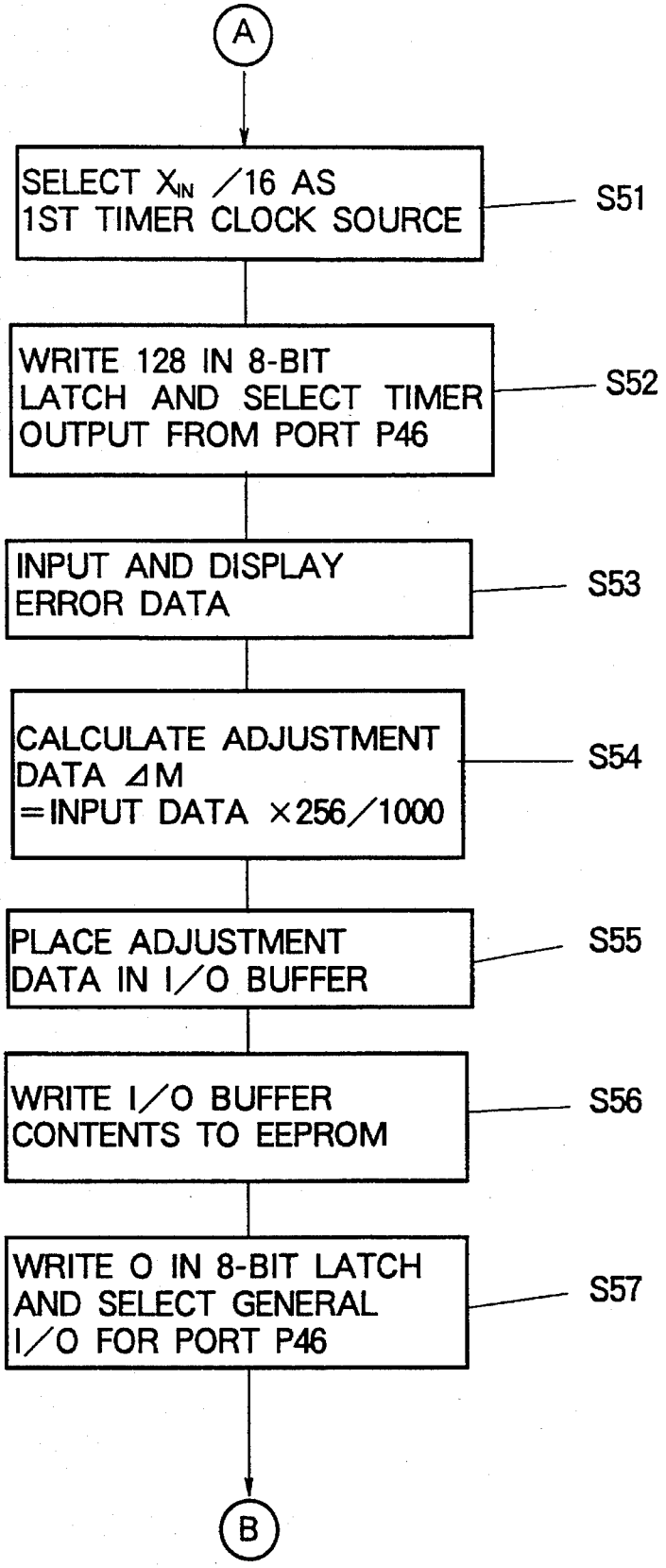
FIG. 13 is a flowchart of a routine for writing adjustment data in the non-volatile memory.

Referring to FIG. 13, in the first step (S51), $X_{IN}$ divided by sixteen is selected as the clock source of the first timer 48, by setting the clock source select switches as shown in FIG. 8.

In the next step (S52), the value 128 is written in the eight-bit latch 53 of the first timer 48, and output port P46 is switched to the first timer output function. As explained above, these operations cause output of a nominally 2048-Hz signal at P46.

Port P46 is coupled to a frequency counter, which measures the frequency coming from port P46 to the nearest thousandth of a hertz. The nominal value is 2048.000 Hz. Assuming the crystal frequency does not deviate by more than ±200 ppm, the frequency error will not exceed ±0.410 Hz.

In the next step (S53), the timer microcontroller 42 inputs the frequency error value. The value can be input by, for example, using the keypad of the remote control unit (not shown) to enter the three digits to the right of the decimal point displayed by the frequency counter. If the frequency error is positive, the input value will be from 001 to 410. If the frequency error is negative, the input value will be from 590 to 999. The timer microcontroller 42 displays the input value on the display device 10 so that correct input can be confirmed.

In the next step (S54), the timer microcontroller 42 calculates the adjustment data ΔM by multiplying the frequency error by 256, then dividing it by 1000. Division by 1000 is necessary because the frequency error was input as a three-digit integer. If the input value was 590 or greater, the timer microcontroller 42 treats the result as a two's complement, indicating a negative value. The resulting ΔM will thus be a signed value not exceeding ±410×256/1000, or ±105.

In the next step (S55), ΔM is written into eight of the sixteen bits of the I/O buffer 62 the timer microcontroller 42 uses to communicate with the EEPROM 7.

In the next step (S56), the timer microcontroller 42 sends the EEPROM 7 a write mode command, followed by the appropriate address, then the data in the I/O buffer 62, causing the value of ΔM to be stored in the EEPROM 7.

Except for the address value, this step S56 is identical to the steps by which the timer microcontroller 42 stores other data, such as voltage values for TV tuning, in the EEPROM 7. This step can accordingly be carried out using a common subroutine, and need not take up extra space in the R0M 45 of the timer microcontroller 42.

In the next step (S57), the eight-bit latch 53 of the first timer 48 is restored to its initial value of zero, and port P46 is restored to its normal input/output port function. Thereafter, the first timer 48 will generate interrupts at the desired rate of 2048 Hz, and will not toggle port P46.

After step S57, setting of the adjustment data ΔM has been completed, so the program returns to the main loop at step S8 in FIG. 10.

The procedure shown in FIG. 13 can be modified in various obvious ways. For example, instead of having the frequency error read from a frequency counter and input on the keypad of the remote control unit, the production line can be furnished with a device that measures the frequency error and transmits the value directly to the remote control receiver 40 of the video cassette recorder. This device can also be adapted to calculate the value of ΔM, obviating the need for step S54 in FIG. 13. The device may furthermore be adapted to write ΔM directly into the EEPROM 7, obviating the need for steps S55 and S56, although in that case the circuit board of the video cassette recorder must be equipped with CS, SK, DI, and DO terminals to which the device can be connected.

The novel feature of the present invention lies in adjusting the time-base cycle length (M) by a certain amount (ΔM) at intervals of N counts. The steps added for this purpose are steps S25, S26, S28, and S29 in FIG. 11, and S41 to S47 in FIG. 12, and the additional RAM areas are the adjustment cycle count 59 and negative-adjust flag 61. The invention can accordingly be practiced by making only relatively small modifications to conventional timer-microcontroller software.

The programs described in FIGS. 10 to 12, like the embodiment shown in FIGS. 1 and 2, adjust the time-base cycle just once per N counts. More specifically, an adjustment of magnitude ΔM is carried out once every 256 seconds. The program could easily be changed, however, to perform one adjustment |ΔM| times, the magnitude of the adjustment being ±1 each time, as in FIG. 4. For example, the first timer interrupt handler could be adapted to add or subtract a value of one from the time-base count 57, instead of adding or subtracting |ΔM|, and to do this |ΔM| times, starting when bit nineteen of the adjustment cycle count 59 was set and continuing until the contents of the eight least significant bits of the adjustment cycle count 59 matched the absolute value of ΔM. The cycle length of the time-base count 57 would then always be 2047, 2048, or 2049 counts, so that the deviation from one second would always be less than a thousandth of a second.

Those skilled in the art will recognize that other modifications can be made to the programs described in FIGS. to 13, the memory data shown in FIG. 9, and the circuits in FIGS. 1 to 8, without departing from the scope of the invention as claimed below.

What is claimed is:

1. A method of generating a time-base signal for time-keeping, comprising the steps of:

storing adjustment data in a non-volatile memory;

generating an oscillator clock signal having a certain oscillator frequency;

counting said oscillator clock signal cyclically with a first cycle length, said first cycle length being programmable, thereby repeatedly generating a time-base cycle;

setting said first cycle length to a nominal value;

setting and resetting said time-base signal once in each said time-base cycle;

counting said oscillator clock signal cyclically with a second cycle length, said second cycle length having a fixed value greater than the nominal value of said first cycle length, thereby repeatedly generating an adjustment cycle;

adjusting said first cycle length by a certain total amount, determined by said adjustment data, in each said adjustment cycle; and restoring said first cycle length to its nominal value in each said adjustment cycle.

2. The method of claim 1, wherein said adjustment data is stored in a one-byte area in said non-volatile memory.

3. The method of claim 1, wherein said first cycle length is adjusted by adding said adjustment data to said nominal value, and is then restored to said nominal value after one said time-base cycle.

4. The method of claim 1, wherein said first cycle length is adjusted by adding a quantity with an absolute value of unity to said nominal value, and is restored to said nominal value after a number of time-base cycles equal in absolute value to said adjustment data.

5. The method of claim 1, wherein said first cycle length is adjusted by adding said adjustment data to a count kept in the step of counting said oscillator clock signal cyclically with a first cycle length.

6. The method of claim 1, comprising the further steps of:

measuring a frequency error of said oscillator frequency with respect to a nominal frequency; and multiplying said frequency error by a constant value, thereby obtaining the adjustment data to be stored in said non-volatile memory.

7. The method of claim 6, wherein the step of measuring said frequency error comprises measuring said oscillator frequency with a frequency counter.

8. The method of claim 6, wherein the step of measuring said frequency error comprises counting a reference signal having a frequency equal to said nominal frequency, during an interval determined by counting said oscillator clock signal.

9. An electronic timekeeping device, comprising:

an oscillator circuit for generating an oscillator clock signal having a certain oscillator frequency;

a programmable counter coupled to count said oscillator clock signal cyclically with a programmable first cycle length, thereby repeatedly generating a time-base cycle, and output a time-base signal with a cycle length equal to said time-base cycle;

an adjustment cycle counter coupled to count said oscillator clock signal cyclically with a constant second cycle length exceeding said first cycle length, thereby repeatedly generating an adjustment cycle;

a non-volatile memory for storing adjustment data; and a control circuit coupled to set said first cycle length to a nominal value, adjust said first cycle length by a certain total amount in each said adjustment cycle, then restore said first cycle length to said nominal value in the same adjustment cycle, said total amount being determined from said adjustment data.

10. The timekeeping device of claim 9, wherein said control circuit adds said adjustment data to said nominal value to obtain their sum, adjusts said first cycle length to equal said sum, then restores said first cycle length to said nominal value after one said time-base cycle.

11. The timekeeping device of claim 10, wherein said control circuit comprises:

a presetting circuit for setting said first cycle length in said programmable counter; and an adder for for adding said adjustment data to said nominal value.

12. The timekeeping device of claim 9, wherein said control circuit adjusts said first cycle length by adding to said nominal value a quantity equal in sign to said adjustment data and in absolute value to unity, and restores said first cycle length to said nominal value after a number of time-base cycles equal in absolute value to said adjustment data.

13. The timekeeping device of claim 12, wherein said control circuit comprises a one-shot counter for counting a number of time-base cycles equal in absolute value to said adjustment data.

14. A timer microcontroller for generating a time-base signal by using an external crystal oscillator and a non-volatile memory, comprising:

an oscillator circuit coupled to said crystal oscillator, for generating an oscillator clock signal;

a timer driven by said oscillator clock signal, for generating timer interrupt requests at regular intervals;

a first memory area for storing a one-second flag;

a second memory area for storing time data;

a third memory area for storing a time-base count that establishes a time-base cycle;

a fourth memory area for storing adjustment data;

a fifth memory area for storing an adjustment-cycle count that establishes an adjustment cycle, said adjustment cycle being longer than said time-base cycle;

a main program having an initialization step for loading said adjustment data from said non-volatile memory into said fifth memory area, and a main loop for updating said time data when said one-second flag is set;

an interrupt handler, executed in response to said timer interrupt requests, for incrementing said time-base count once per timer interrupt request, adjusting said time-base count by a total amount equal to said adjustment data in each said adjustment cycle, and setting said one-second flag once in each said time-base cycle;

a read-only memory for storing said main program and said interrupt handler; and a central processing unit for executing said main program and said interrupt handler.

15. The timer microcontroller of claim 14, wherein said interrupt handler subtracts said adjustment data from said time-base count once in each said adjustment cycle.

16. The timer microcontroller of claim 15, also having a sixth memory area for storing a negative-adjust flag that is set by said interrupt handler if subtracting said adjustment data from said time-base count as described in claim 15 gives a negative result, wherein:

in a time-base cycle in which said negative-adjust flag has been set, said interrupt handler does not set said one-second flag, but clears said negative-adjust flag instead.

17. The timer microcontroller of claim 14, wherein said main program also has a routine for obtaining frequency error data by external input, calculating said adjustment data from said frequency error data, and storing said adjustment data in said non-volatile memory.

* * * * *